US011369530B2

(12) United States Patent
Limontini

(10) Patent No.: US 11,369,530 B2
(45) Date of Patent: Jun. 28, 2022

(54) HYBRID STRETCHER

(71) Applicant: Flavio Limontini, San Pietro Mosezzo (IT)

(72) Inventor: Flavio Limontini, San Pietro Mosezzo (IT)

( * ) Notice: Subject to any disclaimer, the term of this patent is extended or adjusted under 35 U.S.C. 154(b) by 187 days.

(21) Appl. No.: 16/819,066

(22) Filed: Mar. 14, 2020

(65) Prior Publication Data

US 2020/0253797 A1 Aug. 13, 2020

Related U.S. Application Data

(63) Continuation-in-part of application No. PCT/IB2019/050337, filed on Jan. 16, 2019.

(30) Foreign Application Priority Data

Jan. 19, 2018 (IT) ..... 102018000001427

(51) Int. Cl.
*A61G 1/044* (2006.01)
*A61G 1/048* (2006.01)

(52) U.S. Cl.
CPC ..... *A61G 1/044* (2013.01); *A61G 1/048* (2013.01)

(58) Field of Classification Search
CPC ..... A61G 1/044; A61G 1/048
See application file for complete search history.

(56) References Cited

U.S. PATENT DOCUMENTS

| | | | | |
|---|---|---|---|---|
| 4,506,664 | A | 3/1985 | Brault | |
| 5,950,627 | A * | 9/1999 | Bologovsky | A61B 90/00 128/869 |
| 6,065,165 | A | 5/2000 | Delk et al. | |
| 2003/0200972 | A1 | 10/2003 | Crutchfied | |
| 2013/0036552 | A1 | 2/2013 | Davis | |
| 2015/0272792 | A1 | 10/2015 | Driemel et al. | |
| 2018/0028376 | A1* | 2/2018 | Heneveld, Jr. | A61G 1/042 |

FOREIGN PATENT DOCUMENTS

| | | |
|---|---|---|
| GB | 2 320 685 A | 1/1998 |
| TW | 099118856 | 6/2010 |

* cited by examiner

*Primary Examiner* — David R Hare
*Assistant Examiner* — Adam C Ortiz
(74) *Attorney, Agent, or Firm* — Joseph T. Taddeo

(57) ABSTRACT

A stretcher comprising a hollow body made in one piece and extending longitudinally is described. In the stretcher there is an upper seat, intended to accommodate a patient in pronated position that includes a flexible bearing plane surrounded by perimetric retaining side walls. The retaining side walls are tilted with respect to the bearing plane and the lower surface of the hollow rigid body include continuous convex curved struts extending at least under the retaining side walls.

15 Claims, 7 Drawing Sheets

HYBRID STRETCHER

REFERENCE TO PRIOR APPLICATIONS

Applicant claims the benefit of the PCT Application filed on Jan. 16, 2019, (PCT/IB2019/050337), by or on behalf of FLAMOR, S.R.L., designating the United States.

FIELD OF INVENTION

The present invention concerns a stretcher for the transport of traumatized patients, intended in particular, but not exclusively, for use in sports.

Transport and evacuation of patients injured during sport activities are currently rather incomplete operations. In fact, devices generically defined as "stretchers," which come from other specialties to meet specific needs, are then simply adapted to the typical situations of sports competition scenarios. Such adaptation of these stretchers has inevitably highlighted, for the operators in the sector, the inadequacy of the devices, up to a real danger of their use.

PRIOR ART

Different types of stretchers are known in the art. For example, the "pole" type of rescue stretcher essentially constitutes a rigid tubular frame on which a canvas is stretched to accommodate an injured person. The canvas generally yields to the weight of the patient and cannot therefore ensure the correct position of the patient being transported, for example during the carriage of a heavy athlete.

The "scoop" type of stretcher is a special stretcher useful in lifting and transporting an injured patient. It generally consists of two metal shells that are laid down beside a prone patient and which are then joined together in a synchronized movement. However, this requires a complex procedure and consequently longer rescue times.

The spinal board stretcher of board is perfectly flat and designed to achieve the immobilization of the entire body of the patient by maintaining the head, neck and trunk in alignment, especially in case of multiple traumas. However, it has limited dimensions and requires more time and increased difficulty to achieve the correct immobilization of the patient.

The "basket" type of stretcher was originally designed for open sea rescues and is also used for snow rescues or whenever lifting and transport by helicopter is necessary. It has a very high retaining sidewall, therefore there is an enhanced risk of causing further trauma and injuries while laying a patient down within it and during a patient's removal from the stretcher.

Additional prior art includes the following. U.S. Pat. No. 4,506,664 to Brault, Mar. 26, 1985, discloses a spine board having a slide mounted body restraint harness with hooks on strap ends for securing to a buckle. Belts threaded around rollers with teeth can be tightened merely by pulling the belt tight. Air tight buoyancy chambers are included for horizontal flotation of the board in water.

The Patent Application GB 2320685, Jan. 7, 1998, by inventors Bologovsky, et al., describes a spinal board having a rigid body constituted by an outer shell to which stiffening elements are inserted. All of the cavities inside the outer shell are filled with expanded methane foam that also maintains the stiffening elements in position.

U.S. Pat. No. 6,065,165, granted to Delk, at al., May 23, 2000, provides for a patient lying supine on a mattress is engaging a support board fastened to the mattress, whereby to easily turn the patient to a prone position.

In Publication No. US 2003/0200972 A1, dated Oct. 30, 2003, by inventor Crutchfield, there is shown a backboard with indentations to receive specialized padding, plus apertures to accept medical fluid distribution equipment.

R.O.C. Publication No. TW 201144032 A1, of Jun. 20, 2010, by inventor Wei, discloses the method for formation of a spinal board with a hollow portion using pressurized air bags wrapped in fiber inserted between upper and lower mold members to achieve a board of predetermined shape upon removal from the mold.

Patent Application Publication No. US 2013/0036552, A1, Feb. 14, 2013, to Davis, provides an evacuation frame including a support assembly of longitudinally extending opposing poles with slots for a detachable intravenous stand.

The Medical Securing Unit for resonance scans or EMG tests of Driemel at al., Patent Application Publication US 2015/0272792 A1, Oct. 1, 2015, includes one or more strap elements, strap storage and retractor units, the latter comprising first and second defecting rollers and winders.

Meanwhile, Patent Application Publication No US 2018/0028376 A1, dated Feb. 1, 2018, by inventors Heneveld, J R at al., discloses an EMS Backboard with multiple angular pivot points or fulcrums and movable plates for lifting one side of the backboard to roll an injured person thereon for carriage to a medical center. By means of an actuator, the plates may be moved to a deployed position.

The rescue of traumatized sports patients, for example in activities such as football, rugby, soccer, baseball, athletics, racket, tennis, motor sports, basketball, volleyball, handball or gymnastics, with the known types of stretchers is rather critical, perhaps even dangerous for the patient and first aid operators in the field.

It should be noted that the first aid intervention time is often a crucial factor in ensuring prompt treatments and the necessary clinical exams of the patient being transferred by stretcher from the place of injury to a medical center. Important considerations in stretcher design include means for positioning the stretcher proximate to the injured person, ease in pivoting the stretcher to load the patient for carriage, and means for damping forces applied to the stretcher in use for avoidance of further traumas.

SUMMARY OF THE INVENTION

This said, a task of the present invention is to propose an improved stretcher that provides advantages over all of the stretchers currently available on the market.

Thus, a primary object of the present invention is to provide a stretcher that is safe for the patient being laid down and immobilized on the stretcher and for the operators involved in the rescue and transport of the patient.

A further object of the present invention is to provide a stretcher that enables easy loading with rapid and proper immobilization of the patient.

Yet another object of the present invention is to provide a versatile stretcher that can also be used as a spinal board or as a simple stretcher, that further facilitates the patient withdrawal operation and transfer to an ambulatory bed or the like.

Still a further object of the present invention is to provide a stretcher that facilitates medical visit and examination while the patient is immobilized on the stretcher.

An important farther object of the present invention is to provide a lightweight, rugged stretcher.

Yet another object of this invention is to include lateral skids having curvatures that serve as means for sliding the stretcher into position next to the injured person, which serve in combination with rounded pivot points as means for pivoting the stretcher to load the patient for carriage.

Even more significant is the goal to provide an elastic top surface on the stretcher frame that serves as a means for damping forces applied in carriage by first responders, diminishes shocks consequent to air lifting the stretcher, or those resulting from extractions by cable on winches for removals from caves, mountains, ravines or other circumstances fraught with danger.

These and other objects are achieved by the present invention as defined in the claims. In general, a stretcher comprises a rigid body made in one piece and extending longitudinally. In the stretcher there is an upper seat, intended to accommodate a patient in laying position, wherein the upper seat includes a bearing plane surrounded on its perimeter by retaining sidewalls.

According to a possible embodiment of the invention, the essentially rectangular rigid body made in one piece with an underlying hollow area, wherein the retaining side walls are tilted with respect to a bearing plane and the lower surface of the hollow rigid body includes continuous convex curved skids or struts extending at least under the retaining side walls.

Longitudinal stiffening bars can be embodied in the hollow rigid body of the stretcher, for example under the bearing plane, to strengthen the entire structure.

The continuous convex curved portions extend between the lower surface of the hollow rigid body covering each of said longitudinal stiffening bars and the outer surface ends of the retaining side walls.

The inclination of the retaining side walls and the continuous convex curved portions of the lower surfaces arranged under the retaining side walls facilitate the sliding or slipping of the stretcher under the body of the patient whenever "roll" maneuvers are adopted, thereby limiting the risk of causing secondary damages whenever the patient must be laid down on the stretcher. The bearing plane present in the upper seat allows laying down the patient in a correct position, as the one achieved, for example with a spinal board in order to achieve the subsequent immobilization of the patient with the head, neck and trunk aligned correctly.

Advantageously, in an embodiment of the stretcher, the retaining side walls are tilted with respect to the bearing plane by an angle not greater than 35° and protrude from the lower surface of the hollow rigid body by a height exceeding 4½ to 5 inches. The retaining side walls have proper dimensions that make it easier to load the patient on the stretcher and for subsequent removal from the stretcher. With these dimensions, the retaining walls do not constitute a barrier difficult to overcome when a patient sitting or lying down on the ground is loaded and comfortably positioned.

In an embodiment, though-slots, which cross the hollow rigid body longitudinally inside the perimeter of the bearing plane, are advantageously provided. The through-slots are delimited by vertical walls traversing through the upper and lower surfaces of the hollow rigid body. This way, in addition to reducing the weight of the material forming the hollow rigid body, the vertical walls of the slots connecting the upper and lower surfaces of the hollow rigid body serve as shock absorbing means that dampen untoward forces exerted on the stretcher.

It is logical to conclude that the first responders will not have the same attributes. One may be somewhat taller, while another may be stronger, such that in carriage of the stretcher the tall one will lift it upward to a convenient height, while the stronger attendant may exert excess outward force with consequent front-back and lateral forces on the stretcher. The through-slots can be circular, rectangular, triangular or any other shape and different shapes from bottom to top; for example, square at the bottom and round on top. In a preferred embodiment disclosed here, opposed vertical walls of the through-slots are parallel to one another and in turn, parallel to a corresponding stretcher side. Top portions of the through-slots will deform proportionately and directionally responsive to the forces. This is achieved by forming the top seat using rubber or other elastomeric material which can flex and return to its original shape. Adjacent through-slots will have concomitant, coordinated deformations that dampen forces and shocks applied to the stretcher to achieve an equilibrium favorable to the patient.

The foregoing shock absorption feature is also advantageous when first responders use an all-terrain vehicle (ATV) with a cable and mechanized pulley for extractions from rivers or ravines, for example, in national parks, or those by helicopter from mountainous terrain. Such operations impose considerable force on the stretcher, but once the patient is stabilized by the belt system herein disclosed, the slot shock absorbers provide enhanced safety by reduction of potential added trauma to the patient.

In an embodiment of the stretcher according to the invention, immobilization belts emanate from the retaining side walls along the opposed longer sides of the hollow rigid body. The belts are advantageously housed in winders that are tensioned to retain the belts in a fully wound, inoperative condition, an important feature for avoidance of possibly tripping the care givers on belt extensions or entanglement in them.

Furthermore, the belts housed in the respective winders embodied in the hollow rigid body of the stretcher allow attendants to rapidly immobilize the patient by extension of the belts with hand pressure.

The belts are preferably provided with buckles on bitter ends that remain hidden within opposite housings provided in the retaining side walls where the belts are housed in the respective winders in a non-operative condition.

As such, the belts and the respective buckles do not hinder the operations of loading the patient on the stretcher and prevent the first aid operators from accidentally tripping on extended immobilization belts hanging from the stretcher during transport.

In a further embodiment of the present invention, at least three couples of belts are distributed along the opposed largest sides of the hollow rigid body. Advantageously, concurrent tightening means acting on the belts distributed along each of the longest sides of the stretcher are provided. The three couples of belts supplied with the stretcher are positioned at points that facilitate the correct immobilization of the patient, commonly for example at the height of the trunk pelvis and feet, and can be selectively used, depending on the type of injury sustained by patient, or can be combined with possible outer belts.

An embodiment wherein the retaining side walls include a plurality of windows, and wherein at least part of the windows are crossed by a pin for anchoring karabiners or similar means for hooking, is provided. The windows present on the retaining side walls provide a plurality of gripping points that make it easier for the first aid operators to transport the stretcher. Moreover, the presence of pins crossing some windows makes it possible to book outer belts for particular immobilization needs or to anchor the karabiners.

The upper seat intended to accommodate a patient can have, for example, a coarse surface to limit the slipping of the patient laying in the seat, while the lower surface of the hollow rigid body can also be coarse or smooth to control the sideways slipping of the stretcher, particularly when used in indoor sports gymnasiums, for example in basketball, volleyball, handball, roller or ice hockey rinks, etc.

Moreover, in an embodiment a mat made of soft material applied to the bearing plane of the upper seat intended to accommodate a patient can be provided. The mat can be constituted, for example, of a sheet of expanded material applied to the bearing plane in a fixed or removable manner.

In order to facilitate medical intervention, the stiffening bars are preferably made of radiotransparent materials to allow the medical personnel to carry out x-rays without removing the patient from the stretcher.

BRIEF DESCRIPTION OF THE DRAWINGS

Further characteristics and advantages of the present invention will become dearer in the following description, which was made by way of example with reference to the attached drawings, in which.

DETAILED DESCRIPTION

Figure 1:
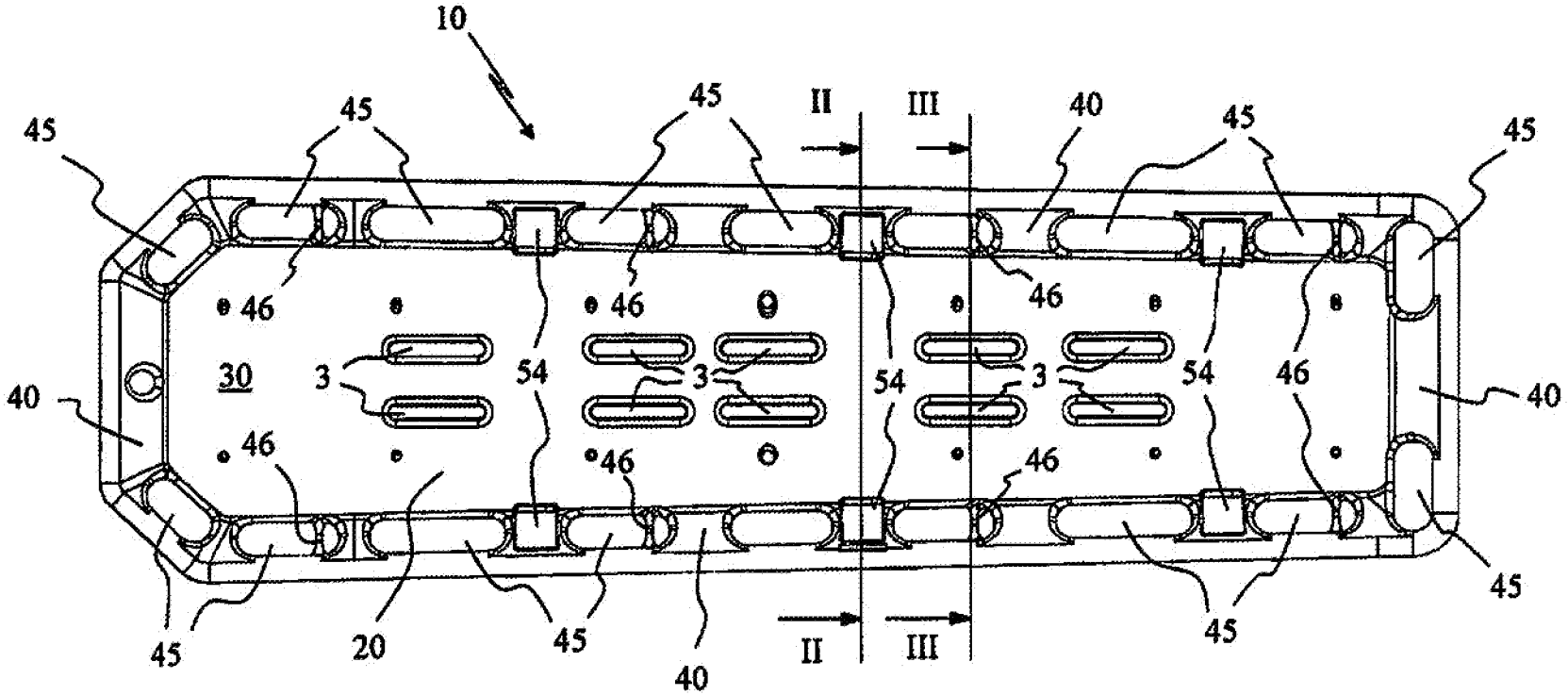
FIG. 1 is a plan view from above of a stretcher according to an embodiment of the invention.

The upper seat 20 of the stretcher 10 designed for accommodating a patient in a prone position is shown in the plan view of FIG. 1. The upper seat 20 includes a bearing plane 30 surrounded on its perimeter by retaining side walls 40.

In particular, the stretcher 10 comprises a hollow rigid body made in one piece of radiotransparent plastic material, such as low-density polyethylene (LDPE) for example, and formed, for example, by rotational molding processes in order to obtain both a robust and light structure and to form possible cavities that are useful in some embodiments. The stretcher 10 preferably has dimensions that are able to accommodate a heavy patient, for example an athlete who plays sports for which there is a high risk of trauma, for example rugby, football and the like. In the embodiment depicted in FIG. 1, the stretcher 10 can have an overall length of six and one-half to seven feet and a maximum width of about one and three-quarters to two feet.

The retaining side walls 40 include a plurality of windows 45 to make it easier for the first responders to grip and transport the stretcher 10. Some windows 45 are crossed by a pin 46 for anchoring karabiners or similar hooking means, to allow hooking the outer immobilization belts that are applied as needed.

In the stretcher 10 depicted in FIG. 1, there are through-slots 3 crossing the hollow body longitudinally. The slots 3 are positioned inside the perimeter of the bearing plane 30 making the overall weight of the rigid hollow body lighter. Moreover, the vertical walls 5 delimiting or defining the slots and traversing the hollow body from the upper to lower surfaces of the hollow body have a rigid bottom portion and a flexible region near the top, as shown in the sectional view of FIG. 3. The vertical walls 5 of the slots 3 traversing through the upper and lower surfaces of the stretcher impart flexibility to the entire structure in addition to reducing the weight of the material forming the hollow rigid body. Furthermore, upper regions of vertical walls 5 of the slots 3 connecting the upper and lower surfaces of the hollow rigid body serve as shock absorbing means that dampen forces exerted on the stretcher 10.

Figure 2:
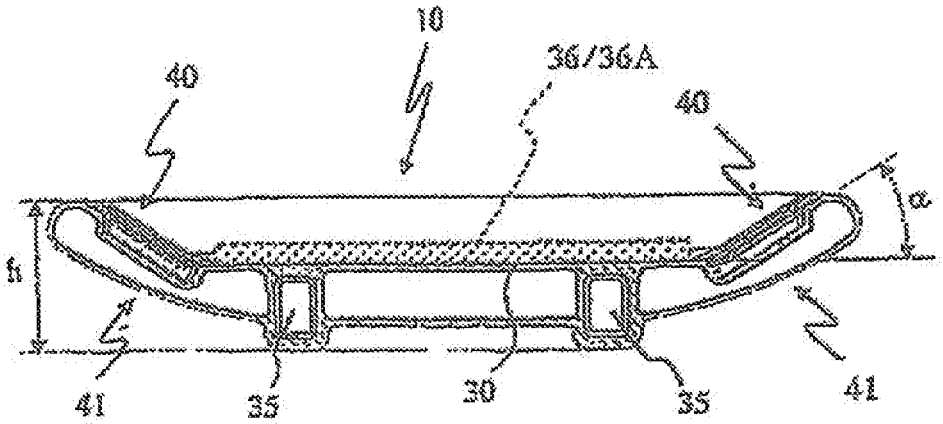
FIG. 2 is a sectional view of the stretcher according to the plan II-II of FIG. 1.
Figure 3:
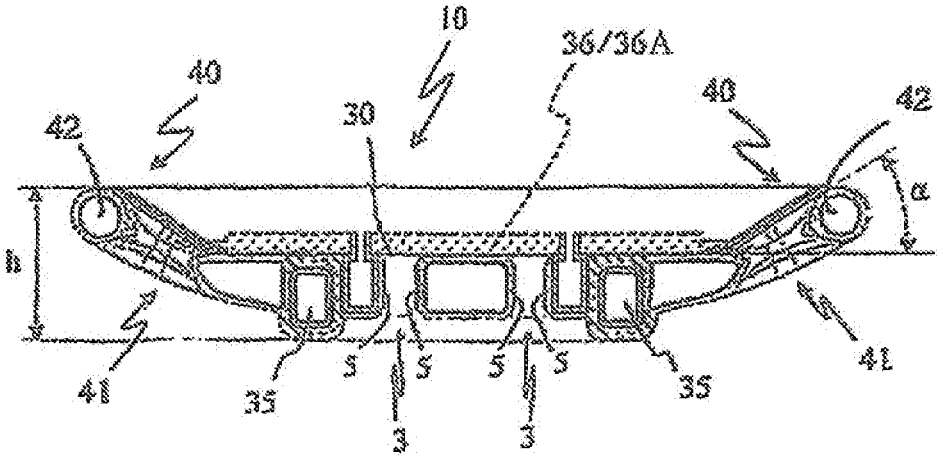
FIG. 3 is a sectional view of the stretcher according to the plan III-III of FIG. 1.

As shown in FIGS. 2 and 3, the retaining side walls 40 are tilted with respect to the bearing plane 30 by an angle, (alpha) $\alpha$ not greater than 35, for example by an angle of about 30°, and protrude from the lower surface of the hollow rigid body by a height not greater than 4 to 5 inches, for example about 4.7 Inches.

The continuous convex curved surface portions 41 of the lower surface of the stretcher 10 at least under the retaining side walls 40 are also highlighted in FIGS. 2 and 3. The continuous convex curved surface portions, skids or struts 41 arranged in co-planar fashion, diminish friction by reducing of points of contact with the underlying surface, facilitate the sideways sliding of the stretcher 10 during the step of loading a patient in the upper seat 20, thus limiting the risk to the patient. Round terminal ends of the skids 41 are co-extensive with handle portions 42, serving as round pivot points for raising the stretcher an a side.

Longitudinal stiffening bars 35 are embedded under the bearing plane 30 of the upper seat 20 to provide morn robustness and rigidity to the bearing plane 30, so that the stretcher 10 can also be used as a spinal board. The longitudinal stiffening bars are preferably made of light radiotransparent material, such as fiberglass or the like for example.

The upper seat 20 intended to accommodate a patient can, for example, have a coarse surface to make it easier to maintain the patient in the seat 20, while the lower surface of the hollow rigid body can, for example, be coarse or smooth, but are preferably smooth especially at the continuous convex curved surface portions 41 in order to facilitate the sideways sliding of the stretcher 10 and, consequently, the step of loading the patient on the stretcher.

Figure 1A:
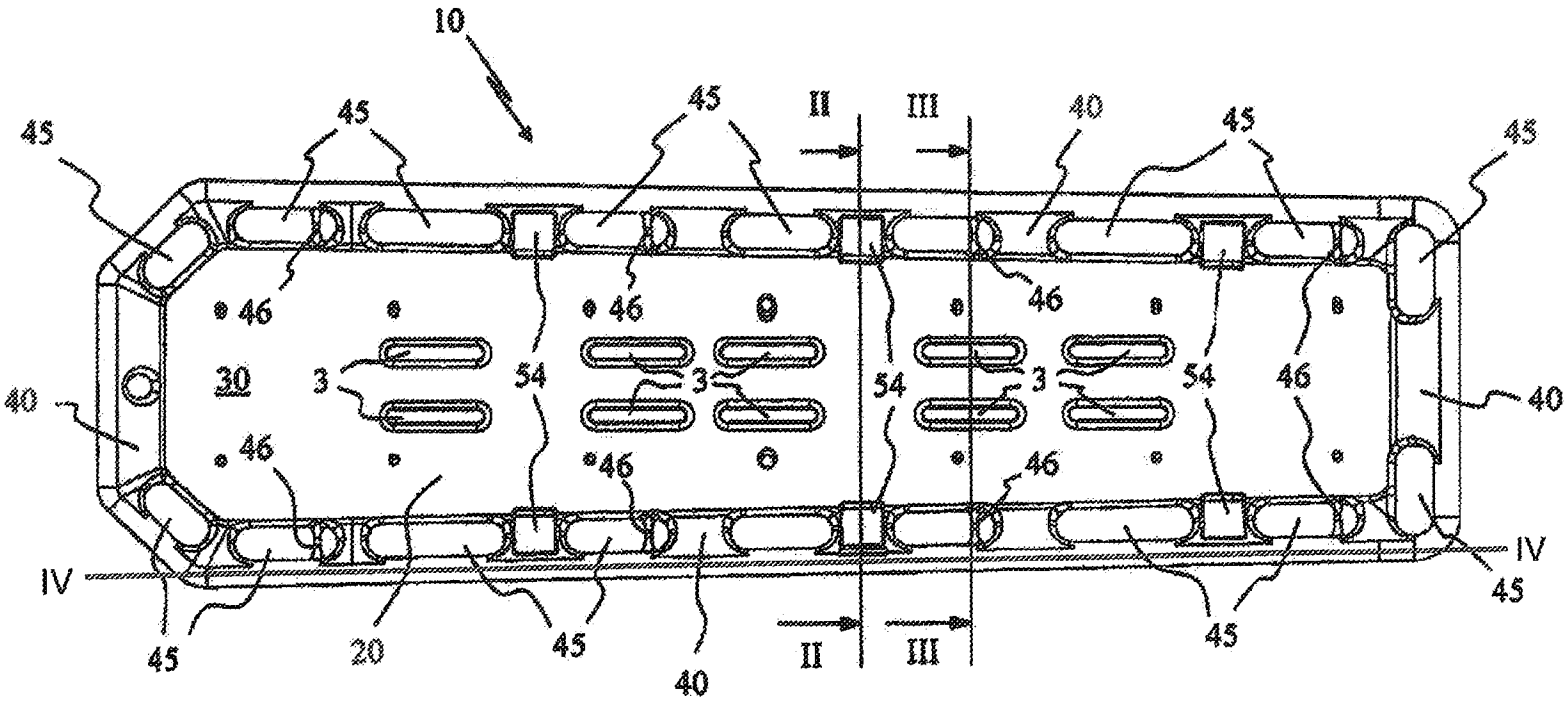
FIG. 1A is a plan view of the stretcher wherein line IV-IV traverses the concentric round terminal ends of the skids and longitudinal carriage handles.

In any case, as depicted in FIGS. 2 and 3, the stretcher 10 can be further provided with a rubber or other elastomeric layer 36 applied to form the bearing plane 20 of the upper seat 20 intended to accommodate a patient. This elastic layer 36, (shown with dash lines), which can flex and return to its original form, can be made during the initial operation by feeding the elastomeric material toward the end of the molding process, whereby the elastic layer is integral with the rectangular stretcher hollow body frame. Or alternatively, the elastic layer 36A (also depicted with dashed lines) can be created in a second procedure by covering the surface of upper seat 20 of the stretcher hollow body with rubber or other elastomeric laminate, preferably a radiotransparent material to enable medical tests and x-rays while a patient remains on the stretcher. Referring to FIG. 1A, the carriage handle 42 is concentric with the round end of each of the skids 41 presenting a round pivot point to raise one side of the stretcher 10. Flexible carriage handles 42 are preferred for providing a minimal sway to the stretcher for diminishing the seemingly unmanageable forces heretofore described. And handles 42 may include a rubber or other flexible material laminate which serves as a grip area to facilitate carriage.

Figure 4:
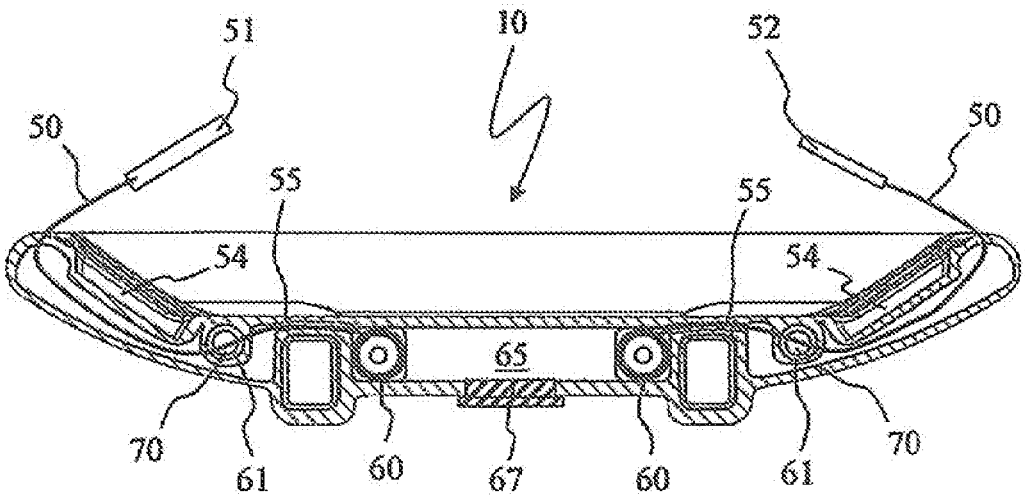
FIG. 4 is a sectional view of a further embodiment of the stretcher according to the present invention in a first condition of use.
Figure 5:
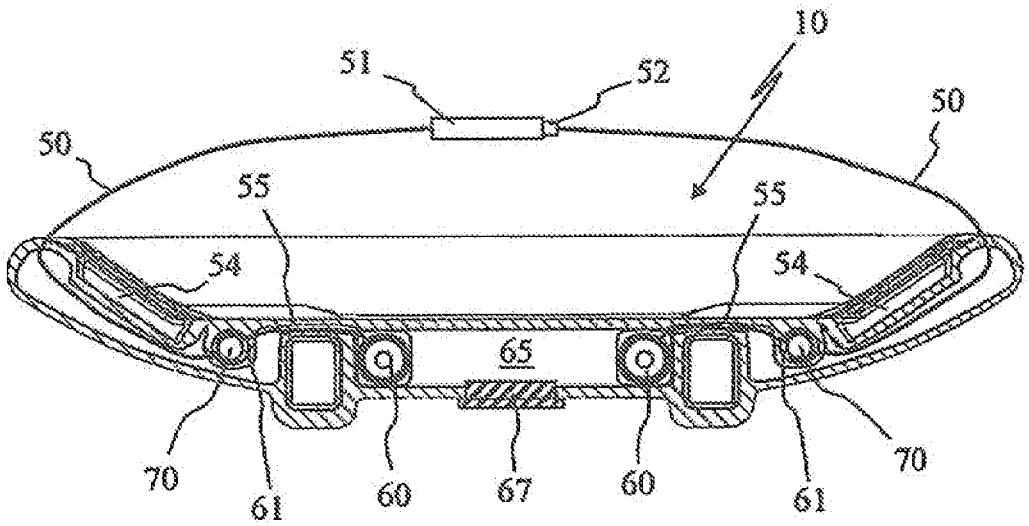
FIG. 5 is a sectional view of the stretcher in FIG. 4 in a second condition of use.

The embodiment depicted in FIGS. 4 and 5 provides a stretcher 10 having belts 50 for immobilizing the patient. The belts 50 come out of the retaining side walls 40 along the opposed largest sides of the stretcher 10 and are housed in winders 60 embodied in the hollow rigid body of the stretcher 10 and tensioned to be fully wound when they are in non-operative condition. The winders 60, preferably provided with elastic return means, are installed in cavities 65 accessible through closed cover openings 67 inserted, for example, by pressure.

The belts 50 are provided at their ends with buckles 51 and 52 that remain hidden inserted in apposite housings 54 (also see FIG. 1) obtained in the retaining side walls 40 when the belts 50 for immobilizing the patient are housed completely in the respective winders 60, i.e. in the non-operative condition.

In the embodiment of FIGS. 4 and 5, three couples of belts 50 for immobilizing the patient and distributed along the opposed longest sides of the stretcher 10, that come out from passage channels 5 arranged, for example, in the lower part of the housings 54 are provided. In order to immobilize the patient more rapidly and safely, concurrent tightening means acting on the belts 50 distributed along each of the largest sides of the stretcher 10 are provided.

Figure 6:
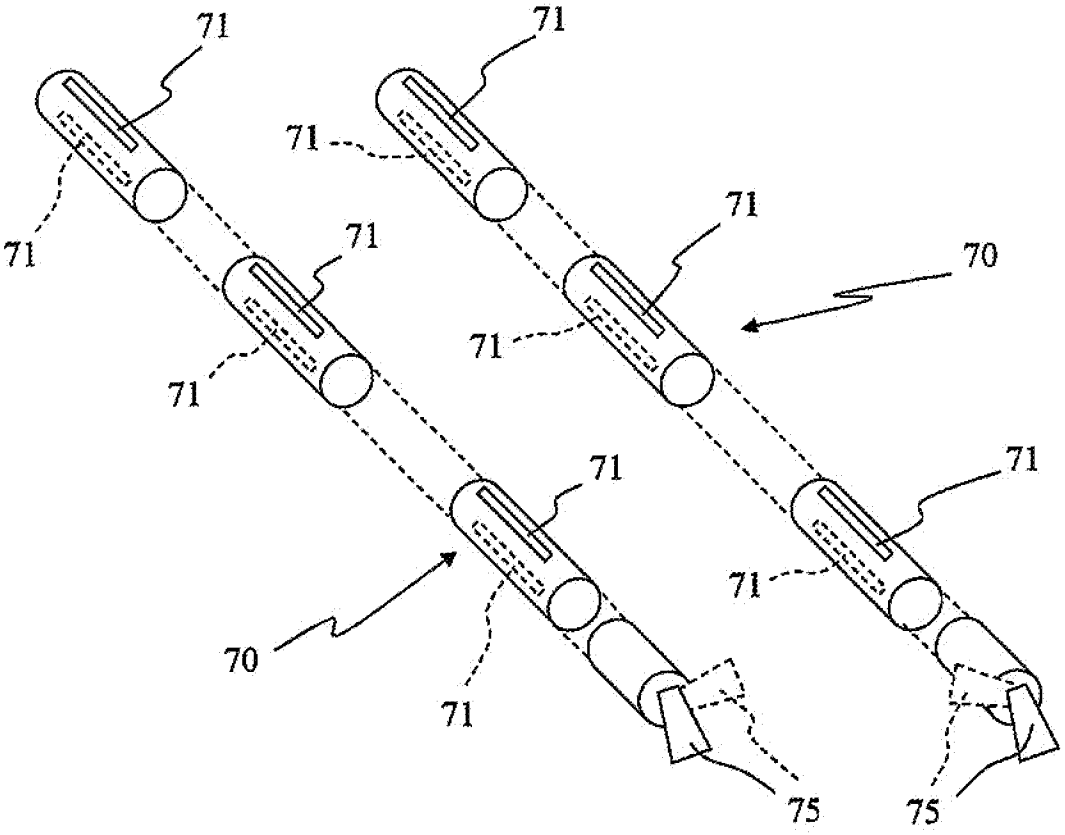
FIG. 6 is a perspective view of some elements of the stretcher depicted in FIGS. 4 and 5.

Said means for concurrent or simultaneous tightening of the belts is consequent to the belts wrapped on spring loaded winders are threaded in splits 71 provided, for example, in tubular bars 70, that are crossed by the immobilization belts 50, wherein the splits of adjacent tubular bars are co-planar in both operative and non-operative conditions, as schematically represented in FIG. 6. The tubular bars 70 are in turn housed as the longitudinal holes 61 provided with passages for the belts 50, and each come out of the hollow rigid body with an activating and locking lever 75.

When the belts 50 must be extracted, the actuating and loading levers 75 are oriented in the position denoted by the solid line in FIG. 6. In this position, corresponding to the condition represented in FIG. 4, the slits 71 of the tubular bars 70 are aligned with the respective passages obtained in the hollow rigid body and the belts 50 can be freely unwound from the winders 60.

Once the buckles 51 and 52 (FIG. 5) are hooked to one another, the elastic return means of the winders 60 make the belts 50 adhere securely to the body of the patient. In this condition the actuating and locking levers 75 can be rotated for a fraction of a revolution, simultaneously realigning the slits 71, as depicted, for example, in FIG. 6 with the dashed lines. As such, the misaligned slits 71 frictionally impinge on the belts 50 and stop further extension. With rotation of the levers, all belts 50 of each side of the stretcher 10 are concurrently locked inside the hollow rigid body and the belt portions longitudinal holes 61, as schematically depicted in FIG. 5.

Figure 7:
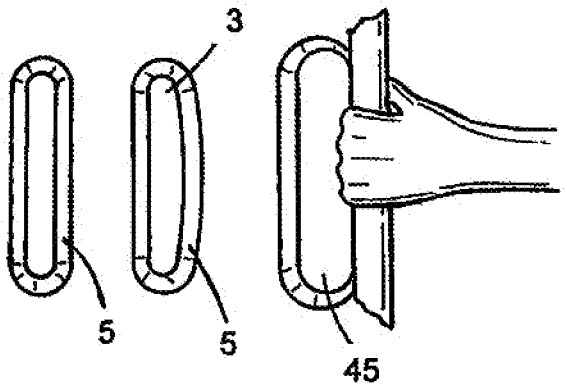
FIG. 7 is an elevation view of a first slot wall flexed by force applied in carriage.
Figure 8:
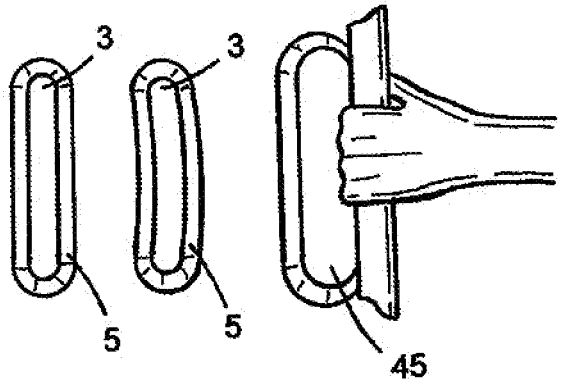
FIG. 8 is an elevation view of a second slot wall distortion from additional force applied.
Figure 9:
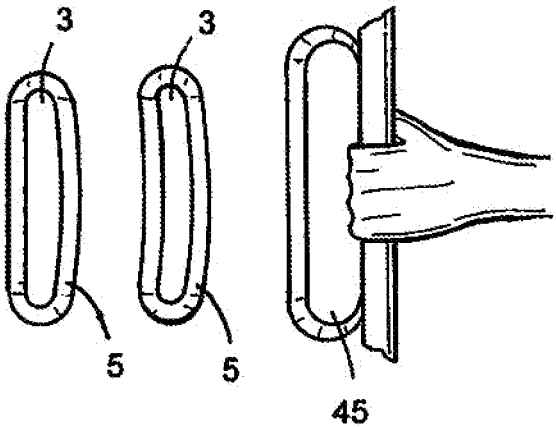
FIG. 9 is an elevation view of first and second slot walls flexed and the wall of an adjacent slot also distorted from yet a stronger force or shock applied.

FIG. 7 indicates how opposed vertical walls 5 of the slots 3, will temporarily deform proportionately and directionally responsive to the forces imposed on the stretcher during carriage. In FIG. 8, adjacent slots 3 will have concomitant, coordinated deformations that serve as means for dampening shocks to achieve an equilibrium favorable to the patient. FIG. 9 demonstrates that the walls of adjacent slots will likewise deform responsive to further forces or shocks applied to the stretcher. Upon completion of carriage for a particular patient, the rubber or other elastomeric material provides for return of the through-slot walls to their original form.

Figure 10:
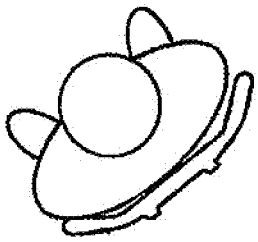
FIG. 10 is an end view of the stretcher in use with curved skids, round handle and co-extensive round skid ends combining to position the stretcher proximate to a patient.
Figure 11:
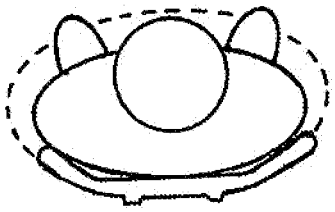
FIG. 11 is a top view of the stretcher in use to safely roll a patient aboard the stretcher.

FIGS. 10 and 11 demonstrate the ease of patient loading on the stretcher if roll loading procedure is indicated to be tolerable for the patient.

Variations and modifications can be made to the embodiments described herein without departing from the scope of the invention. For example, shapes and materials can vary depending on particular needs and the various embodiments can be combined with one another for use as a spinal board or simple stretcher, also with the use of outer belts that can be anchored to the walls or apposite karabiner pins.

The invention claimed is:

1. A stretcher comprising a substantially rectangular frame with upper and lower surfaces and a longitudinally extending flat bearing plain positioned centrally on the frame and flanked on each longer side by retaining side walls extending radially less than 5 inches and tilted upward at an angle $\alpha$ not exceeding 35° with respect to said flat bearing plain, the stretcher including a plurality of co-planar curved skids with round terminal ends which are positioned under the retaining side walls for reduced friction when sliding the stretcher in proximity to a patient for loading and to brace the stretcher when carried;

wherein the round terminal ends of the skids are concentric with a plurality of stretcher carriage handles to provide a rounded pivot point for pivoting and loading the patient on the stretcher;

further comprising longitudinal stiffening bars embedded under the flat bearing plain, parallel to one another and to long sides of the rectangular stretcher, to balance the stretcher when carried.

2. The stretcher as defined in claim 1, further comprising a means for damping untoward forces or shocks which may be exerted on the stretcher during carriage of patients.

3. The stretcher defined in claim 2, the means for damping comprising a plurality of through-slots are positioned longitudinally within the flat bearing plain, said through slots delimited by vertical walls traversing the substantially rectangular frame from the upper to lower surfaces, having a rigid portion proximate to the lower surface and a flexible portion proximate to the upper surface that impart flexibility to the substantially rectangular frame.

4. The stretcher defined in claim 3, wherein the through-slot vertical walls form variant shapes of the through-slots including substantially square through the lower surface and substantially oval through the upper surface of the substantially rectangular frame body.

5. The stretcher defined in claim 4, further comprising deformation of the through-slot vertical walls concomitant and proportionate to shocks and forces applied, and restoration of the through-slot walls to an original shape upon abatement of forces on the stretcher.

6. The stretcher as defined in claim 5, wherein said continuous convex curved skids extend from a lower surface of the rigid rectangular frame covering each of said longitudinal stiffening bars and peripheral surface ends of said retaining side walls.

7. The stretcher as defined in claim 6, wherein the retaining side walls include a plurality of windows for ease of first responders to grip and transport the stretcher.

8. The stretcher as defined in claim 7, wherein some windows are crossed by a pin for anchoring karabiners that allow hooking outer immobilization belts that are applied as needed.

9. The stretcher as defined in claim 8, wherein there are belts for immobilizing the patient that emanate from the retaining side walls along the opposed longest sides of the stretcher, and wherein the belts are housed in winders in the rigid rectangular frame when in a non-operative condition.

10. The stretcher as defined in claim 9, wherein the ends of the belts are provided with buckles that remain hidden inserted in opposite housings obtained in the retaining side walls where the belts for immobilizing the patient are housed completely in the respective winders in a non-operative condition.

11. The stretcher as defined in claim 10, wherein at least three pairs of belts are provided for immobilizing the patient and distributed along the opposed longest sides.

12. The stretcher as defined in claim 11, a concurrent tightening means comprising a plurality of tubular bars with splits to receive an end of each belt, wherein the tubular bars are in turn housed in longitudinal holes provided with passages for the belts, and each of the plurality of tubular bars projects from the hollow rigid body having at a terminal end of an activating and locking lever.

13. The stretcher as defined in claim 12, wherein as the buckles are hooked to one another, the belts secured on the patient, in which condition the belts crossing the slits wedged into the tubular bars and the locking levers can be rotated a fraction of a revolution, and consequent to this rotation, all belts of each side of the stretcher are concurrently locked inside the rigid rectangular frame.

14. The stretcher as defined in claim 13, further comprising flexible carriage handles for providing a minimal sway to the stretcher which further diminish forces experienced by the patient during carriage.

15. The stretcher as defined in claim 14, wherein the flexible carriage handles include a rubber or other flexible material laminate which serves as a grip area to facilitate carriage.

* * * * *